US010467951B2

(12) United States Patent
Bae et al.

(10) Patent No.: US 10,467,951 B2
(45) Date of Patent: Nov. 5, 2019

(54) METHOD FOR PROCESSING IMAGE AND ELECTRONIC DEVICE SUPPORTING THE SAME

(71) Applicant: SAMSUNG ELECTRONICS CO., LTD., Suwon-si, Gyeonggi-do (KR)

(72) Inventors: Jong Kon Bae, Seoul (KR); Yo Han Lee, Seoul (KR); Yun Pyo Hong, Seoul (KR); Dong Kyoon Han, Seongnam-si (KR); Min Su Han, Suwon-si (KR); Hong Kook Lee, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/690,500

(22) Filed: Aug. 30, 2017

(65) Prior Publication Data

US 2018/0061308 A1 Mar. 1, 2018

(30) Foreign Application Priority Data

Aug. 30, 2016 (KR) ..... 10-2016-0111126

(51) Int. Cl.
*G09G 5/397* (2006.01)
*G09G 3/20* (2006.01)
(Continued)

(52) U.S. Cl.
CPC ..... *G09G 3/2096* (2013.01); *G09G 5/006* (2013.01); *G09G 5/377* (2013.01); *G09G 5/393* (2013.01);
(Continued)

(58) Field of Classification Search
CPC ..... G09G 5/39; G09G 5/393; G09G 5/399; G09G 2360/18; G09G 2330/621; G06F 3/0659; G06F 3/0661
See application file for complete search history.

(56) References Cited

U.S. PATENT DOCUMENTS 7,495,709 B2 2/2009 Abe
7,843,511 B2 11/2010 Kang et al.
(Continued)

FOREIGN PATENT DOCUMENTS

EP 1 662 795 11/2005
JP 07255019 3/1995

OTHER PUBLICATIONS

Search Report and Written Opinion dated Dec. 21, 2017 in counterpart International Patent Application No. PCT/KR2017/009492.
(Continued)

*Primary Examiner* — Antonio A Caschera
(74) *Attorney, Agent, or Firm* — Nixon & Vanderhye P.C.

(57) ABSTRACT

An electronic device includes a display panel that outputs content through a plurality of pixels, a display driver integrated circuit configured to transmit a driving signal for driving the display panel, and a processor configured to transmit image data and/or a control signal to the display driver integrated circuit. In the case where the display driver integrated circuit receives first image data transmitted together with a command of a first command group from the processor, the display driver integrated circuit is configured to store the first image data in a first memory area. In the case where the display driver integrated circuit receives second image data transmitted together with a command of a second command group from the processor, the display driver integrated circuit is configured to store the second image data in a second memory area different from the first memory area.

18 Claims, 10 Drawing Sheets

(51) Int. Cl.

| | |
|---|---|
| ***G09G 5/377*** | (2006.01) |
| ***G09G 5/393*** | (2006.01) |
| ***G09G 5/00*** | (2006.01) |

(52) U.S. Cl.

CPC ..... *G09G 5/397* (2013.01); *G09G 2310/08* (2013.01); *G09G 2330/021* (2013.01); *G09G 2330/022* (2013.01); *G09G 2340/02* (2013.01); *G09G 2340/12* (2013.01); *G09G 2360/18* (2013.01); *G09G 2370/022* (2013.01); *G09G 2370/08* (2013.01); *G09G 2370/10* (2013.01)

(56) References Cited

U.S. PATENT DOCUMENTS

| | | | |
|---|---|---|---|
| 8,478,075 | B2 | 7/2013 | Lee |
| 8,537,201 | B2 | 9/2013 | Choi et al. |
| 8,629,886 | B2 * | 1/2014 | Michail ..... G06T 15/503 345/419 |
| 8,787,701 | B2 | 7/2014 | Lee |
| 9,250,695 | B2 | 2/2016 | Tse |
| 9,514,511 | B2 | 12/2016 | Lee et al. |
| 9,753,527 | B2 | 9/2017 | Connell et al. |
| 2006/0012715 | A1 | 1/2006 | Abe |
| 2006/0114363 | A1 | 6/2006 | Kang et al. |
| 2011/0057952 | A1 | 3/2011 | Lee |
| 2012/0092450 | A1 | 4/2012 | Choi et al. |
| 2013/0272628 | A1 | 10/2013 | Lee |
| 2014/0132800 | A1 | 5/2014 | Onuma |
| 2014/0281607 | A1 | 9/2014 | Tse |
| 2014/0333608 | A1 | 11/2014 | Okairi et al. |
| 2015/0130824 | A1 | 5/2015 | Lee et al. |
| 2015/0185811 | A1 | 7/2015 | Connell et al. |
| 2015/0185815 | A1 | 7/2015 | DeBates et al. |
| 2015/0277545 | A1 | 10/2015 | Flowers et al. |
| 2016/0027146 | A1 | 1/2016 | Kim et al. |
| 2016/0063948 | A1 | 3/2016 | Han |
| 2016/0140893 | A1 | 5/2016 | Bae et al. |

OTHER PUBLICATIONS

Partial Supplementary European Search Report dated Mar. 19, 2019 for EP Application No. 17846996.1.

Extended European Search Report dated Jun. 21, 2019 for EP Application No. 17846996.1.

* cited by examiner

METHOD FOR PROCESSING IMAGE AND ELECTRONIC DEVICE SUPPORTING THE SAME

CROSS-REFERENCE TO RELATED APPLICATION

This application is based on and claims priority under 35 U.S.C. § 119 to a Korean patent application filed on Aug. 30, 2016 in the Korean Intellectual Property Office and assigned Serial number 10-2016-0111126, the disclosure of which is incorporated by reference herein in its entirety.

TECHNICAL FIELD

The present disclosure relates generally to a method for outputting an image through a display driver integrated circuit, and an electronic device supporting the same.

BACKGROUND

An electronic device such as a smartphone, a table PC, a smart watch, or the like may output a variety of content such as a picture, an image, text, and the like through a display panel. The display panel may be driven through a display driver integrated circuit (DDI). The display driver integrated circuit may receive image data from a processor in the electronic device and may output the received image data through the display panel.

The display driver integrated circuit may store image data to be output through each of pixels constituting a display in units of a frame and may output the stored image data through the display depending on a specified timing signal.

A conventional display driver integrated circuit may perform a simple function in which the conventional display driver integrated circuit receives image data from a processor and outputs the received image data through a display panel. In addition, in the case where the conventional display driver integrated circuit outputs an analog clock, a digital clock, and the like in an always on display (AOD) scheme, an application processor should be in a driving state repeatedly, and power consumed upon driving the application processor is increased.

SUMMARY

In accordance with an example aspect of the present disclosure, an electronic device may include a display panel that outputs content through a plurality of pixels, a display driver integrated circuit that transmits a driving signal for driving the display panel, and a processor configured to transmit image data or a control signal to the display driver integrated circuit. In the case where the display driver integrated circuit receives first image data transmitted together with a command of a first command group from the processor, the display driver integrated circuit may store the first image data in a first memory area. In the case where the display driver integrated circuit receives second image data transmitted together with a command of a second command group from the processor, the display driver integrated circuit may store the second image data in a second memory area distinguished from the first memory area.

According to various example embodiments, an image output method and an electronic device supporting the same may include an additional sub memory distinguished from a conventional graphics RAM in a display driver integrated circuit, thus storing an additional image output together with a main image (or a background image).

According to various example embodiments, the image output method and the electronic device supporting the same may implement hour/minute/second of an analog clock using an additional image depending on an internal clock signal of the display driver integrated circuit, even in the case where an application processor is in a sleep state.

According to various example embodiments, the image output method and the electronic device supporting the same may minimize and/or reduce an operation of an application processor in an always on display (AOD) type output state, thereby reducing power consumption.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and attendant advantages of the present disclosure will be more apparent and readily appreciated from the following detailed description, taken in conjunction with the accompanying drawings, in which like reference numerals refer to like elements, and wherein.

Throughout the drawings, it should be noted that like reference numbers are used to depict the same or similar elements, features, and structures.

DETAILED DESCRIPTION

Figure 1:
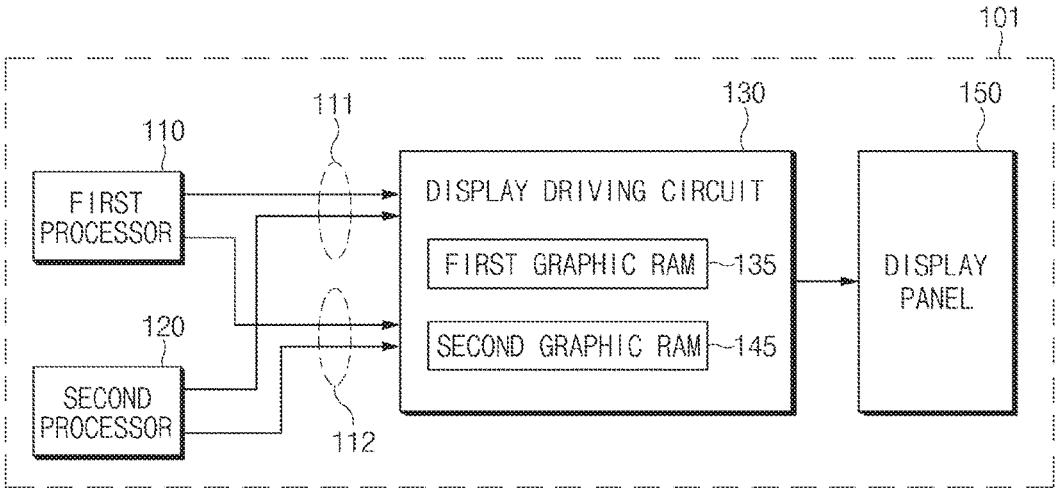
FIG. 1 is a block diagram illustrating an example electronic device according to various example embodiments.

Hereinafter, various example embodiments of the present disclosure will be described with reference to the accompanying drawings. Accordingly, those of ordinary skill in the art will recognize that various modifications, equivalents, and/or alternatives of the various embodiments described herein can be variously made without departing from the scope and spirit of the present disclosure. With regard to description of drawings, similar components may be marked by similar reference numerals.

In the disclosure, the expressions "have", "may have", "include" and "comprise", or "may include" and "may comprise" used herein indicate existence of corresponding features (for example, elements such as numeric values, functions, operations, or components) but do not exclude presence of additional features.

In the disclosure, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used herein may refer to various elements of various embodiments of the present disclosure, but do not limit the elements. For example, such terms are used only to distinguish an element from another element and do not limit the order and/or priority of the elements. For example, a first user device and a second user device may represent different user devices irrespective of sequence or importance. For example, without departing the scope of the present disclosure, a first element may be referred to as a second element, and similarly, a second element may be referred to as a first element.

It will be understood that when an element (for example, a first element) is referred to as being "(operatively or communicatively) coupled with/to" or "connected to" another element (for example, a second element), it can be directly coupled with/to or connected to the other element or an intervening element (for example, a third element) may be present. On the other hand, when an element (for example, a first element) is referred to as being "directly coupled with/to" or "directly connected to" another element (for example, a second element), it should be understood that there are no intervening element (for example, a third element).

According to the situation, the expression "configured to" used herein may be used interchangeably with, for example, the expression "suitable for", "having the capacity to", "designed to", "adapted to", "made to", or "capable of". The term "configured to (or set to)" must not refer only to "specifically designed to" in hardware. Instead, the expression "a device configured to" may refer to a situation in which the device is "capable of" operating together with another device or other components. For example, a "processor configured to (or set to) perform A, B, and C" may refer, for example, and without limitation, to a dedicated processor (for example, an embedded processor) for performing a corresponding operation or a generic-purpose processor (for example, a central processing unit (CPU) or an application processor) which may perform corresponding operations by executing one or more software programs which are stored in a memory device.

Terms used in this disclosure are used to describe various embodiments of the present disclosure and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the specification, they may not be interpreted to exclude embodiments of the present disclosure.

An electronic device according to various example embodiments of the present disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), MP3 players, mobile medical devices, cameras, and wearable devices, or the like, but is not limited thereto. According to various example embodiments of the present disclosure, the wearable devices may include accessories (for example, watches, rings, bracelets, ankle bracelets, glasses, contact lenses, or head-mounted devices (HMDs)), cloth-integrated types (for example, electronic clothes), body-attached types (for example, skin pads or tattoos), or implantable types (for example, implantable circuits), or the like but are not limited thereto.

In some embodiments of the present disclosure, the electronic device may be one of home appliances. The home appliances may include, for example, at least one of a digital video disk (DVD) player, an audio, a refrigerator, an air conditioner, a cleaner, an oven, a microwave oven, a washing machine, an air cleaner, a set-top box, a home automation control panel, a security control panel, a TV box (for example, Samsung HomeSync™, Apple TV™, or Google TV™), a game console (for example, Xbox™ or PlayStation™), an electronic dictionary, an electronic key, a camcorder, or an electronic panel, or the like, but are not limited thereto.

In another embodiment of the present disclosure, the electronic device may include at least one of various medical devices (for example, various portable medical measurement devices (a blood glucose meter, a heart rate measuring device, a blood pressure measuring device, and a body temperature measuring device), a magnetic resonance angiography (MRA), a magnetic resonance imaging (MRI) device, a computed tomography (CT) device, a photographing device, and an ultrasonic device), a navigation system, a global navigation satellite system (GNSS), an event data recorder (EDR), a flight data recorder (FDR), a vehicular infotainment device, electronic devices for vessels (for example, a navigation device for vessels and a gyro compass), avionics, a security device, a vehicular head unit, an industrial or home robot, an automatic teller's machine (ATM) of a financial company, a point of sales (POS) of a store, or an internet of things (for example, a bulb, various sensors, an electricity or gas meter, a spring cooler device, a fire alarm device, a thermostat, an electric pole, a toaster, a sporting apparatus, a hot water tank, a heater, and a boiler), or the like, but is not limited thereto.

According to some embodiments of the present disclosure, the electronic device may include at least one of a furniture or a part of a building/structure, an electronic board, an electronic signature receiving device, a projector, or various measurement devices (for example, a water service, electricity, gas, or electric wave measuring device), or the like, but is not limited thereto. In various embodiments of the present disclosure, the electronic device may be one or a combination of the aforementioned devices. The electronic device according to some embodiments of the present disclosure may be a flexible electronic device. Further, the electronic device according to an embodiment of the present disclosure is not limited to the aforementioned devices, but may include new electronic devices produced due to the development of technologies.

Hereinafter, electronic devices according to an example embodiment of the present disclosure will be described with reference to the accompanying drawings. The term "user" used herein may refer to a person who uses an electronic device or may refer to a device (for example, an artificial electronic device) that uses an electronic device.

FIG. 1 is a block diagram illustrating an example electronic device according to various example embodiments.

Referring to FIG. 1, an electronic device 101 may be a device having a screen output function. For example, the electronic device 101 may, for example, and without limitation, be a mobile device such as a smartphone, a tablet PC, or the like, or a wearable device such as a smart watch, a smart band, or the like. The electronic device 101 may include a first processor (e.g., including processing circuitry) 110, a second processor (e.g., including processing circuitry) 120, a display driver integrated circuit 130, and a display panel 150.

For example, the first processor 110 may include various processing circuitry and perform operations or data processing associated with a control and/or a communication of one or more different elements. In various example embodiments, the first processor 110 may include various processing circuitry, such as, for example, and without limitation, at least one of a dedicated processor, a central processing unit (CPU) or an application processor (AP).

The first processor 110 may transmit image data associated with a background image to be output through the display panel 150, to the display driver integrated circuit 130. The display driver integrated circuit 130 may store the image data in a first graphic random access memory (RAM) (or first memory area) 135. The first graphics RAM 135 may be referred to herein as a "frame buffer" or "line buffer".

An image (hereinafter referred to as a "main image") output through the stored image data may be output in a frame unit through the display panel 150. For example, in the case where the display panel 150 outputs a screen at a speed of 60 frames per second, the first processor 110 may transmit image data corresponding to one frame to the display driver integrated circuit 130 60 times per second. The display driver integrated circuit 130 may generate the main image based on each piece of the image data and may output the main image through the display panel 150.

According to various example embodiments, in the case where a first frame being currently output is the same as a second frame to be output next to the first frame, the first processor 110 may not transmit additional image data to the display driver integrated circuit 130. In this case, the display driver integrated circuit 130 may continuously output a still image stored in the first graphics RAM 135 of the display driver integrated circuit 130.

According to various example embodiments, the first processor 110 may provide data processed by a specified algorithm to the display driver integrated circuit 130. For example, the first processor 110 may compress screen frame data with a specified algorithm and may provide the compressed screen frame data to the display driver integrated circuit 130 at a high speed. The display driver integrated circuit 130 may decompress a compressed image and may output the decompressed image through the display panel 150.

In various example embodiments, the first processor 110 may transmit data associated with an image (hereinafter referred to as an "additional image") output together with the main image to the display driver integrated circuit 130 through a first channel 111. The display driver integrated circuit 130 may store data associated with the additional image in a second graphics RAM (or second memory area) 145 distinguished from the first graphics RAM 135 in which the main image is stored. The display driver integrated circuit 130 may combine and output the main image with the additional image based on an internal clock signal, a control signal provided from the first processor 110, or the like. Additional information associated with transmission of the data associated with the main image and the additional image, an output of the combined image, and the like may be described in greater detail below with reference to FIGS. 2 to 9.

The second processor 120 may include various processing circuitry and be a separate processor distinguished from the first processor 110. Unlike the first processor 110, the second processor 120 may be a processor performing an operation needed to execute a specified function. The second processor 120 may include various processing circuitry, such as, for example, and without limitation, a module or a chip such as a communication processor (CP), a touch control circuit, a touch pen control circuit, a sensor hub, or the like.

The display driver integrated circuit 130 may be a driver circuit for outputting an image through the display panel 150. The display driver integrated circuit 130 may receive the image data from the first processor 110 or the second processor 120 and may output the image through image conversion.

According to various example embodiments, the display driver integrated circuit 130 may include the second graphics RAM (a second memory area, a side graphics RAM or a sub graphics RAM) 145 distinguished from the first graphics RAM 135. The second graphics RAM 145 may store part of the image data transmitted from the first processor 110. The display driver integrated circuit 130 may store image data classified as the additional image depending on a type of a command transmitted from the first processor 110, a characteristic of data, and the like, in the second graphics RAM 145. Additional information associated with a way to store the image data in the second graphics RAM 145 may be described in greater detail below with reference to FIGS. 3 to 7.

In an example embodiment, the second graphics RAM 145 may be a separate memory that is distinguished from the first graphics RAM 135 in hardware. The first graphics RAM 135 and the second graphics RAM 145 may be storage areas that are distinguished in the same physical memory.

The display driver integrated circuit 130 may combine the main image, which is based on the main image data stored in the first graphics RAM 135, with the additional image through a sub display driver integrated circuit 140 and may output the combined image through the display panel 150.

The display panel 150 may output content such as an image, a text, and the like. The display panel 150 may be, for example, a liquid-crystal display (LCD) panel, an active-matrix organic light-emitting diode (AM-OLED) panel, or the like, but is not limited thereto. For example, the display panel 150 may be implemented flexibly, transparently, or to be wearable. For example, the display panel 150 may be included in a cover of a case electrically coupled to the electronic device 101.

The display panel 150 may receive a signal associated with the main image or the additional image from the display driver integrated circuit 130 and may output the signal. The display panel 150 may be implemented such that a plurality of data lines and a plurality of gate lines cross each other. At least one pixel may be disposed at an intersection of the data line and the gate line. In the case where the display panel 150 is an OLED panel, the display panel 150 may include one or more switching elements (e.g., FET) and corresponding OLED. Each pixel may receive an image signal from the display driver integrated circuit 130 at specific timing to generate light.

According to various example embodiments, the first channel 111 may be a channel to secure a data transmission speed higher than that of a second channel 112 through which a control signal is transmitted. For example, the first channel 111 may be a high speed serial interface (HiSSI), and the second channel 112 may be a low speed serial interface (LoSSI).

Figure 2:
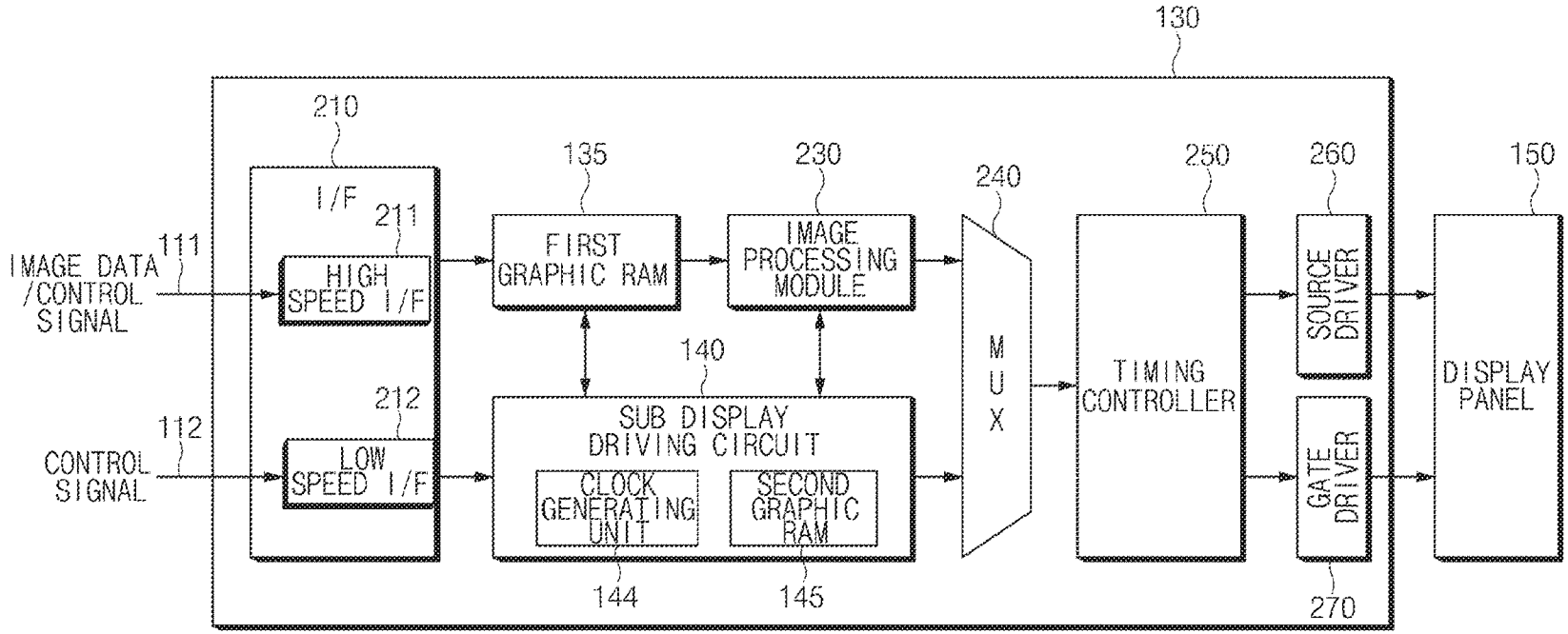
FIG. 2 is a block diagram illustrating an example display driver integrated circuit according to various example embodiments.

FIG. 2 is a block diagram illustrating an example configuration of a display driver integrated circuit according to various example embodiments.

Referring to FIG. 2, the display driver integrated circuit 130 may include an interface module (e.g., including interface circuitry) 210, the first graphics RAM 135, an image processing module (e.g., including image processing circuitry) 230, the sub display driver integrated circuit 140, a multiplexer 240, a timing controller 250, a source driver 260, and a gate driver 270. The sub display driver integrated circuit 140 may include a clock generating unit (e.g. including clock generating circuitry) 144 and the second graphics RAM 145.

The interface module 210 may include various interface circuitry and receive image data or a control signal from the first processor 110 or the second processor 120. The interface module 210 may include a high speed serial interface (HiSSI) 211, and a low speed serial interface (LoSSI) 212. The HiSSI 211 may include a mobile industry processor interface (MIPI), a mobile display digital interface (MDDI), a compact display port (CDP), a mobile pixel link (MPL), current mode advanced differential signaling (CMADS), and the like. Below, a description will be given with reference to an MIPI-based interface without being limited thereto.

The HiSSI (e.g., mobile industry processor interface (MIPI)) 211 may receive image data from the first processor 110 or the second processor 120 and may provide the image data to the first graphics RAM 135. The HiSSI 211 may quickly transmit the image data, the amount of which is greater than that of a control signal. In various example embodiments, the HiSSI 211 may receive and process the control signal from the first processor 110 or the second processor 120. The HiSSI 211 may transfer the received control signal to an internal element of the display driver integrated circuit 130.

The LoSSI (e.g., a serial peripheral interface (SPI) and an inter-integrated circuit (I2C)) 212 may receive the control signal from the first processor 110 or the second processor 120 and may provide the control signal to the sub display driver integrated circuit 140.

In various example embodiments, the interface module 210 may further include a controller (not illustrated) which controls the HiSSI 211 and the LoSSI 212.

In various embodiments, a graphics RAM (GRAM) controller (not illustrated) may be additionally disposed between the interface module 210 and the first graphics RAM 135. A command controller (not illustrated) may be additionally disposed between the interface module 210 and the sub display driver integrated circuit 140.

The first graphics RAM 135 may store the image data provided from the first processor 110 or the second processor 120. The first graphics RAM 135 may include a memory space corresponding to a resolution and/or the number of color gradations of the display panel 150. The first graphics RAM 135 may be referred to herein, for example, as a "frame buffer" or "line buffer".

The image processing module 230 may include various image processing circuitry and perform image conversion on the image data stored in the first graphics RAM 135. The image data stored in the first graphics RAM 135 may be in the form of data processed by a specified algorithm. For example, the image data may be compressed by a specified algorithm for rapid transmission and may be transmitted through the first channel 111. The image processing module 230 may decompress the compressed image and may provide the decompressed image to the display panel 150. In various example embodiments, the image processing module 230 may enhance image quality of the image data. Although not illustrated in FIG. 2, the image processing module 230 may include, for example, and without limitation, a pixel data processing circuit, a pre-processing circuit, a gating circuit, and the like.

The sub display driver integrated circuit 140 may perform an operation associated with processing the additional image combined with the main image. The additional image may be output to a partial area or a specific area of the display panel 150. For example, the additional image may be hour hand/minute hand/second hand of an analog clock, a number (e.g., 00 second to 59 seconds), or a division sign (:) of a digital clock.

According to various example embodiments, the sub display driver integrated circuit 140 may include the clock generating unit 144 and the second graphics RAM 145.

The clock generating unit 144 may include various clock generating circuitry and generate a timing signal periodically. The sub display driver integrated circuit 140 may output the additional image depending on a clock signal of the clock generating unit 144 at a specified time (e.g., a time when data of the main image is received, a time when data is stored in the first graphics RAM 135, a time when a separate control signal is received, or the like). For example, the sub display driver integrated circuit 140 may perform an operation of a second unit based on a signal generated from the clock generating unit 144 and may generate hour hand/minute hand/second hand of an analog clock as the additional image by using the operation result.

The second graphics RAM 145 may store part of the image data transmitted from the first processor 110. The display driver integrated circuit 130 may store image data that is classified as the additional image depending on a type of a command transmitted from the first processor 110, a characteristic of data, and the like, in the second graphics RAM 145.

The multiplexer 240 may combine a signal associated with the main image output from the image processing module 230 with a signal associated with the additional image output from the sub display driver integrated circuit 140 and may provide the combined signals to the timing controller 250.

The timing controller 250 may generate a source control signal for controlling operation timing of the source driver 260 and a gate control signal for controlling operation timing of the gate driver 270, based on the signal combined by the multiplexer 240.

The source driver 260 and the gate driver 270 may generate signals to be supplied to a scan line and a data line of the display panel 150, based on the source control signal and the gate control signal respectively received from the timing controller 250.

Figure 3:
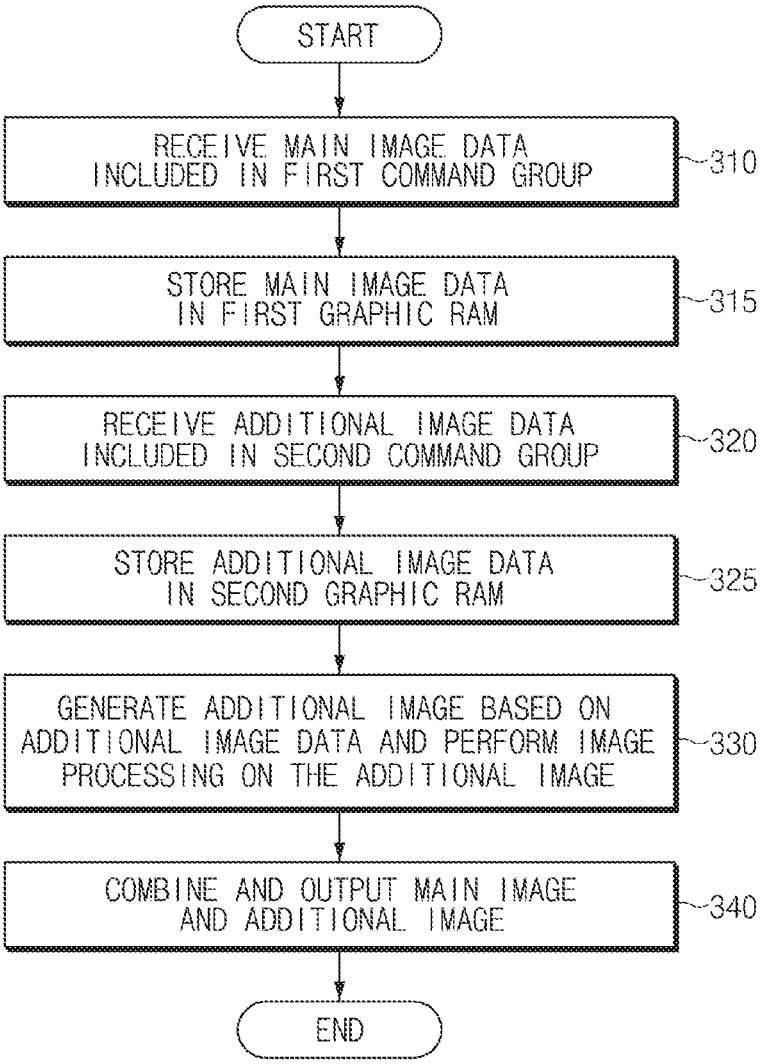
FIG. 3 is a flowchart illustrating an example image processing method according to various example embodiments.

FIG. 3 is a flowchart illustrating an example image processing method according to various example embodiments.

Referring to FIG. 3, in operation 310, the display driver integrated circuit 130 may receive main image data included in a first command group. For example, the first command group may be a 2Ch command or a 3Ch command according to an MIPI standard. Each command may be stored in a header of a packet transmitted from the first processor 110, and the main image data may be included in a payload of the packet.

In operation 315, the display driver integrated circuit 130 may store the main image data in the first graphics RAM 135. The display driver integrated circuit 130 may toggle a signal indicating to start to store, to continuously store, and the like depending on a type of the command included in the first command group.

In operation 320, the display driver integrated circuit 130 may receive additional image data included in a second command group. For example, the second command group may be a 4Ch command or a 5Ch command according to the MIPI standard. Each command may be stored in the header of the packet transmitted from the first processor 110, and the additional image data may be included in the payload of the packet.

In operation 325, the display driver integrated circuit 130 may store the additional image data in the second graphics RAM 145. The display driver integrated circuit 130 may toggle a signal indicating to start to store, to continuously store, and the like depending on a type of the command included in the second command group.

According to various example embodiments, in operation 330, the display driver integrated circuit 130 may generate an additional image based on the data stored in the second graphics RAM 145 and may perform image processing such as rotation, combination, or the like. For example, the display driver integrated circuit 130 may rotate an hour hand image of an analog clock stored in the second graphics RAM 145, by a specified degree depending on a timing signal of the clock generating unit 144 in the display driver integrated circuit 130.

In operation 340, the display driver integrated circuit 130 may combine and output a main image with an additional image. In an example embodiment, the main image and the additional image may be output as one combined image in which data is not distinguished from each other. In another example embodiment, the main image may be output on a first layer, and the additional image may be added on a second layer, a third layer and the like which are stacked on the first layer.

According to various example embodiments, a method for processing an image, performed in an electronic device including a display, includes generating, at a processor, first image data to be transmitted together with a command of a first command group, transmitting, by the processor, the first image data to a display driver integrated circuit driving the display, storing, at the display driver integrated circuit, the first image data in a first memory area, generating, at the processor, second image data to be transmitted together with a command of a second command group, transmitting, by the processor, the second image data to the display driver integrated circuit, and storing, at the display driver integrated circuit, the second image data in a second memory area.

According to various example embodiments, the method further includes operating, by the display driver integrated circuit, the display based on the first image data and the second image data if the processor is in an inactive state.

According to various example embodiments, the generating of the second image data includes generating additional information based on transparency of each of pixels, and generating conversion data including the additional information wherein the conversion data is smaller in size than base data of the pixels.

Figure 4A:
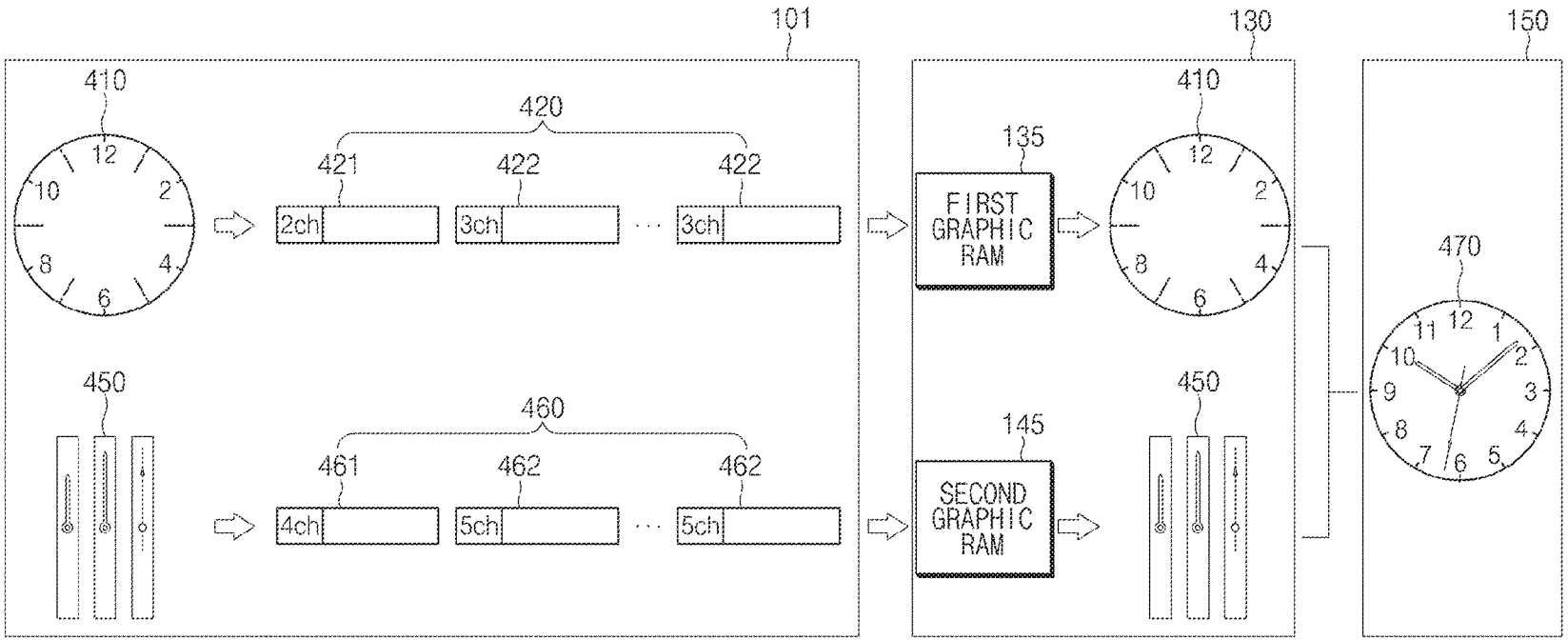
FIG. 4A is a diagram illustrating example transmission of a main image or an additional image through different command groups, according to various example embodiments.

FIG. 4A is a diagram illustrating example transmission of a main image or an additional image through different command groups, according to various example embodiments.

Referring to FIG. 4A, the first processor 110 may packetize main image data 410 to a first command group 420. The first command group 420 may include a recording start command 421 and a recording continuousness command 422.

Each of the recording start command 421 and the recording continuousness command 422 may include header information for storing data in the first graphics RAM 135 of the display driver integrated circuit 130, and main image data to be stored in first graphics RAM 135. For example, the recording start command 421 may be a 2Ch command according to an MIPI standard, and the recording continuousness command 422 may be a 3Ch command according to the MIPI standard.

The first processor 110 may packetize additional image data 450 to a second command group 460.

The second command group 460 may include a recording start command 461 and a recording continuousness command 462. Each of the recording start command 461 and the recording continuousness command 462 may include header information for storing data in the second graphics RAM 145 of the display driver integrated circuit 130, and additional image data to be stored in the second graphics RAM 145.

For example, the recording start command 461 may be a command (e.g., a 4Ch command) other than a 2Ch command and a 3Ch command among commands from 00h to FFh according to the MIPI standard, and the recording continuousness command 462 may be one command (e.g., a 5Ch command) other than the 2Ch command, the 3Ch command and a command determined as the recording start command 461.

In the case where the display driver integrated circuit 130 receives a packet from the first processor 110, the display driver integrated circuit 130 may verify the header information. In the case where the command of the first command group 420 is included in the header information, the display driver integrated circuit 130 may store image data in the first graphics RAM 135. An image stored in the first graphics RAM 135 may be used as a main image (or background image). The main image (or background image) may be continuously output in the same form during a specified time or until a specified event occurs. For example, the main image (or background image) may be maintained until an event that the first processor 110 is out of a sleep state occurs or until an event that a user changes the background image occurs.

In the case where the command of the second command group 460 is included in the header information, the display driver integrated circuit 130 may store image data in the second graphics RAM 145. An image stored in the second graphics RAM 145 may be used as an additional image which is output together with the main image. The additional image may be continuously updated in units of a specified time (e.g., one second) or depending on occurrence of a specified event. For example, the additional image may be hour hand/minute hand/second hand of an analog clock, and a location of the additional image may be updated in units of a second depending on a clock signal of the clock generating unit 144 in the display driver integrated circuit 130.

The display driver integrated circuit 130 may combine and output the main image 410 with the additional image 450. For example, the main image 410 may be a background image of an analog clock, and the additional image 450 may be an image of hour hand/minute hand/second hand being output while being overlaid on the background image.

The display panel 150 may output one combined image (or an image in which a plurality of layers are overlaid) 470.

Figure 4B:
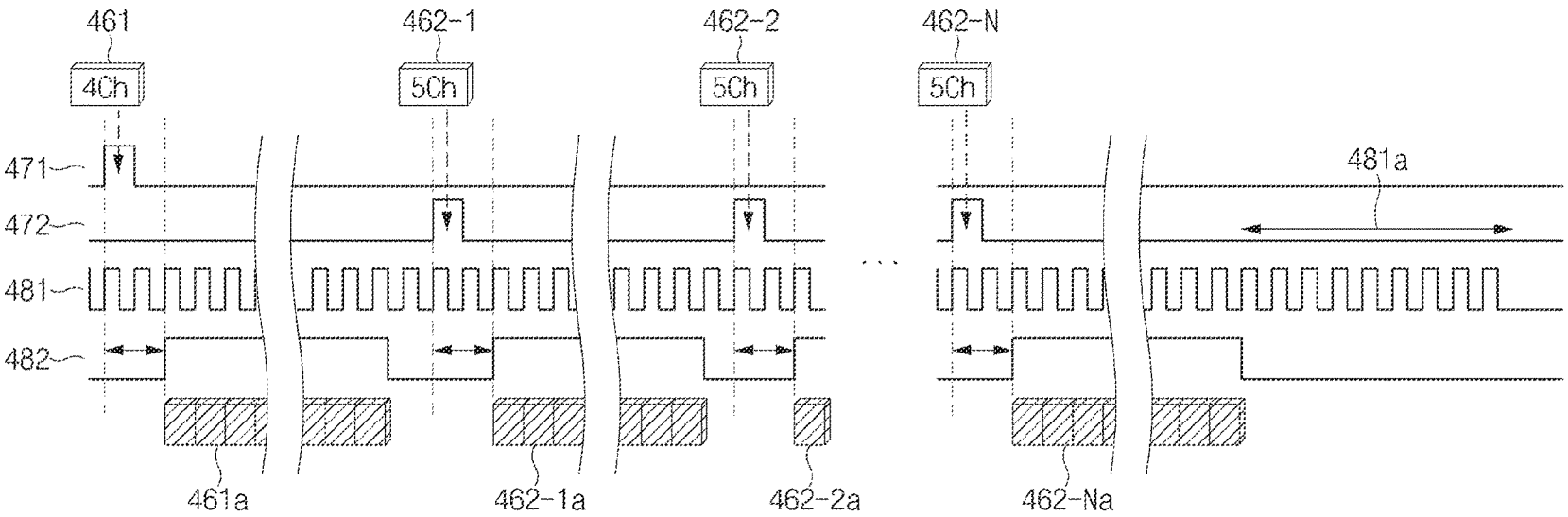
FIG. 4B is a diagram illustrating an example streaming signal for storing an additional image in the display driver integrated circuit according to various example embodiments.

FIG. 4B is a diagram illustrating an example streaming signal for storing an additional image in a display driver integrated circuit according to various example embodiments. FIG. 4B is merely an example, and the disclosure is not limited thereto.

Referring to FIG. 4B, the sub display driver integrated circuit 140 may receive such a streaming signal as illustrated in FIG. 4B, from the interface module 210. The streaming signal may be input in a regular form regardless of the number of lanes of an interface between the first processor 110 and the interface module 210.

In the case where the display driver integrated circuit 130 recognizes a recording start command (e.g., a 4Ch command) 461, the display driver integrated circuit 130 may toggle a recording start signal 471 to start to record additional image data in the second graphics RAM 145.

After a state of the recording start signal 471 is changed, a specified waiting time elapses depending on a clock signal 481, and the display driver integrated circuit 130 may change a state of a data store signal 482. The waiting time may be changed depending on a memory access speed, a status of a memory, and the like.

While the data store signal 482 maintains a high state, additional image data 461*a* included in the recording start command 461 may be stored in the second graphics RAM 145. In the case where the additional image data 461*a* is completely stored, the data store signal 482 may be changed to a low state.

After the additional image data 461*a* is completely stored, in the case where the display driver integrated circuit 130 recognizes the recording continuousness command 462-1 (e.g., a 5Ch command), the display driver integrated circuit 130 may toggle a recording continuousness signal 472 to continuously record the additional image data in the second graphics RAM 145.

After a state of the recording continuousness signal 472 is changed, a specified waiting time may elapse depending on the clock signal 481, and the display driver integrated circuit 130 may change the state of the data store signal 482.

While the data store signal 482 maintains the high state, additional image data 462-1*a*, 462-2*a*, . . . , and 462-Na included in the recording continuousness command 462 may be stored in the second graphics RAM 145. In the case where the additional image data 462*a* is completely stored, the data store signal 482 may be changed to the low state.

According to various embodiments, additional image data by one recording start command 461 and a plurality of recording continuousness commands 462-1, 462-2, . . . , and 462-N may be stored in the second graphics RAM 145.

According to various example embodiments, after the additional image data by the last recording continuousness command 462 is completely stored, the display driver integrated circuit 130 may maintain the toggling of the clock signal 481 during a specific additional time (or dummy time) 481*a* (e.g., 8 clocks or more). During the dummy time, a work to store the second graphics RAM 145 may be completed.

Figure 5:
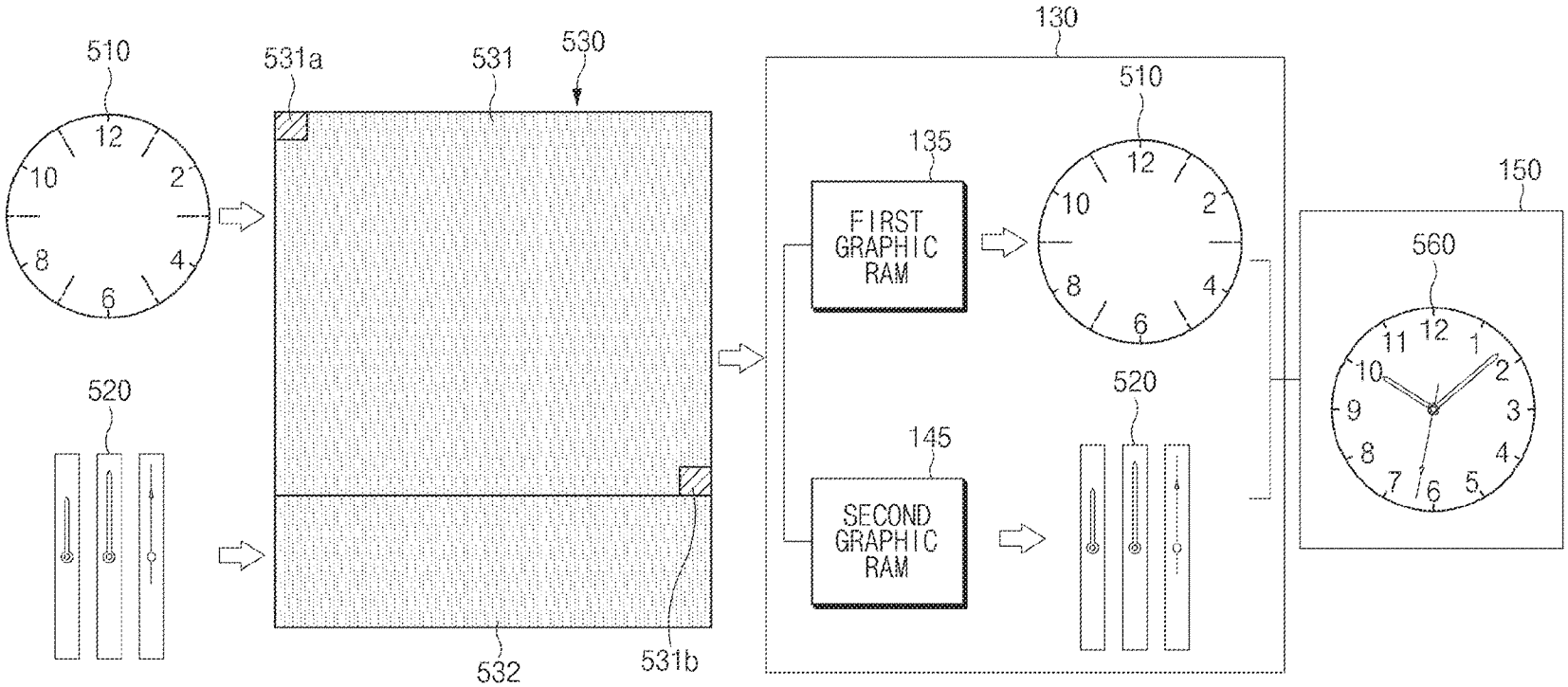
FIG. 5 is a diagram illustrating an example process to combine and transmit a main image and an additional image, according to various example embodiments.

FIG. 5 is a diagram illustrating an example associated with a way to combine and transmit a main image and an additional image, according to various example embodiments.

Referring to FIG. 5, the first processor 110 may generate combined image data 530 by sequentially combining data associated with a main image 510 and data associated with an additional image 520. The combination image data 530 may include a first area 531 in which main image data is included and a second area 532 in which additional image data is included. The combination image data 530 may be transmitted to the display driver integrated circuit 130 after being packetized to a plurality of packets depending on a specified protocol.

According to various example embodiments, the combination image data 530 may include a start sign (e.g., start_column and start_page) 531*a* indicating a start of a column (or a page) at a start point of the first area 531. In the case where the display driver integrated circuit 130 recognizes the start sign 531*a*, the display driver integrated circuit 130 may start storing an image data in the first graphics RAM 135.

According to an example embodiment, the combination image data 530 may include an end sign (e.g., end_column and end_page) 531*b* indicating an end of the column (or the page) at an end point of the first area 531. In the case where the display driver integrated circuit 130 recognizes the end sign 531*b*, the display driver integrated circuit 130 may end the storing of the image data in the first graphics RAM 135 and may start storing the image data in the second graphics RAM 145.

According to another example embodiment, the combination image data 530 may include an end sign (not illustrated) (e.g., end_column and end_page) indicating an end of a column (or a page) at an end point of the second area 532. After the display driver integrated circuit 130 starts recording main image data, the display driver integrated circuit 130 may store received data, the size of which is greater than that of specified main image data, in the second graphics RAM 145. In the case where the display driver integrated circuit 130 recognizes the end sign (now shown), the display driver integrated circuit 130 may end recording of additional data.

The display driver integrated circuit 130 may combine and output the main image 510 with the additional image 520. For example, the main image 510 may be a background image of an analog clock, and the additional image 520 may be an image of hour hand/minute hand/second hand being output while being overlaid on the background image.

The display panel 150 may output one combined image (or an image in which a plurality of layers are overlaid) 560.

Figure 6:
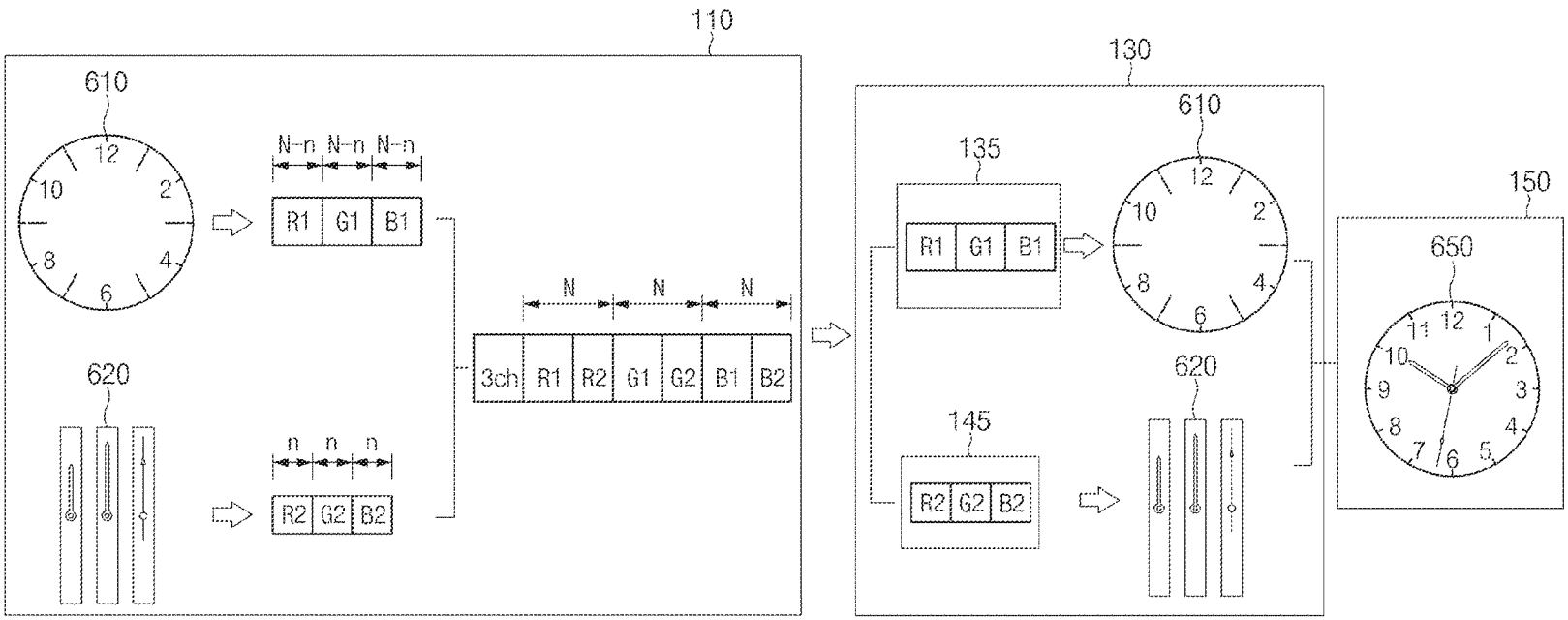
FIG. 6 is a diagram illustrating an example in which part of image data is stored by a first command group as additional image data, according to various example embodiments.

FIG. 6 is a diagram illustrating an example in which part of image data by a first command group is stored as additional image data, according to various example embodiments. The case of a 3Ch command according to an MIPI standard is illustrated as an example in FIG. 6. However, it will be understood that the disclosure is not limited thereto.

Referring to FIG. 6, in the case where each of R, G, and B values of each pixel in the display panel 150 is set to have a bit width of N bits, image data to be output through one pixel may be formed of 3N bits.

The first processor 110 may allocate some (e.g., n bits) of N bits for expressing the R, G, and B values of the pixel as data for an additional image. The first processor 110 may allocate (N-n) bits to each of R1, G1, and B1 of a main image 610 and may allocate n bits to each of R2, G2, and B2 of an additional image 620. The first processor 110 may combine R1, G1, and B1 of the main image 610 with R2, G2, and B2 of the additional image 620 to one command and may transmit the command to the display driver integrated circuit 130.

For example, in the case where each of R, G, and B of each pixel in the display panel 150 is set to have a bit width of 8 bits, the first processor 110 may allocate 5 bits to each of R1, G1, and B1 of the main image 610 to generate main image data and may allocate 3 bits to each of R2, G2, and B2 of the additional image 620 to generate the additional image data. The first processor 110 may combine R1, G1, and B1 with R2, G2, and B2 to generate one command and may transmit the command to the display driver integrated circuit 130.

In image data included in a received command, the display driver integrated circuit 130 may store R1, G1, and B1 associated with the main image of the image data in the first graphics RAM 135 and may store R2, G2, and B2 associated with the additional image in the second graphics RAM 145. The display panel 150 may output one combined image (or an image in which a plurality of layers are overlaid) 650.

Figure 7:
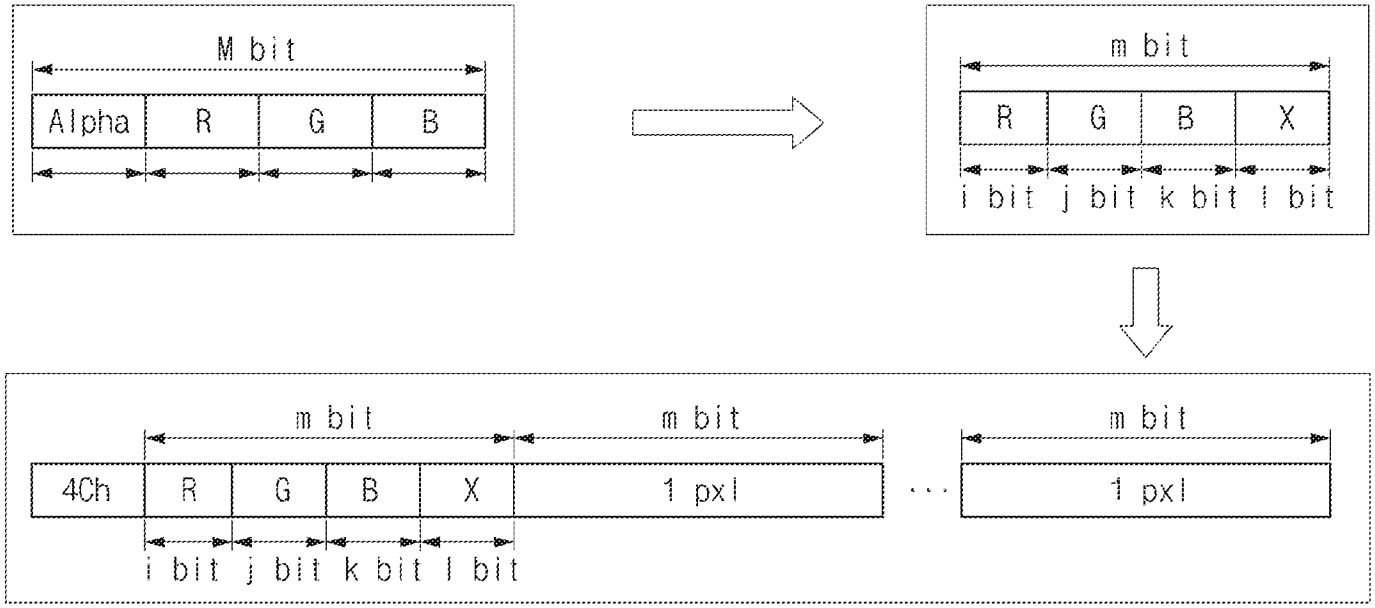
FIG. 7 is a is a diagram illustrating an example of how additional information are applied in a processor, according to various example embodiments.

FIG. 7 is a diagram illustrating how additional information is applied in a processor, according to various example embodiments. FIG. 7 is an example, and it will be understood that the disclosure is not limited thereto.

Referring to FIG. 7, the first processor 110 may generate a command in which additional information "X" is additionally added to R, G, and B values of each pixel. The additional information "X" may be data including transparency information, edge information, and the like.

With regard to one pixel, the first processor 110 may convert M-bit base data (e.g., 32-bit data) in which transparency (alpha) and R, G, and B values are included into m-bit data (e.g., 24-bit data) allocated to one pixel in the display driver integrated circuit 130. The M-bit base data (e.g., if (alpha, R, G, B) is (8, 8, 8, 8), M=32 bits) including transparency information may be greater than m-bit data (e.g., if (R, G, B) is (8, 8, 8), m=24 bits) including only R, G, and B values.

The first processor 110 may determine an edge (e.g., a pixel disposed between an area having transparency of 100 and an area having transparency of lower than 100) of an additional image, based on an alpha value. For example, the first processor 110 may determine whether each pixel corresponds to an edge, through a correlation relation with peripheral pixels based on an alpha value of each pixel.

The first processor 110 may correct R, G, and B values of each pixel depending on a direction of a detected edge pixel. In various embodiments, the first processor 110 may decrease some of bits allocated to R, G, and B of each pixel and may record the additional information "X" such as the edge information, the transparency information and the like in the remaining data area.

For example, the first processor 110 may allocate "i" bits to R, "j" bits to G, "k" bits to B, and "l" bits to X. A sum of bits of the R, G, B, and X may be the same as a size of m bits allocated to one pixel in the display driver integrated circuit 130 (i+j+k+l=m).

The first processor 110 may extract the additional information such as edge detection information and the like and may transmit data including the additional information to the display driver integrated circuit 130. In this case, the throughput of the display driver integrated circuit 130 may be reduced. An operating speed of the display driver integrated circuit 130 may be slower than an operating speed of the first processor 110. The first processor 110 may preferentially perform a work needing a lot of throughput instead of the display driver integrated circuit 130, thereby reducing an operation load of the display driver integrated circuit 130. For example, to rotate hands of an analog clock, the first processor 110 may process an anti-aliasing work to allow the display driver integrated circuit 130 to output an additional image to rotate a hand of a clock directly without performing an operation for the anti-aliasing work.

Figure 8:
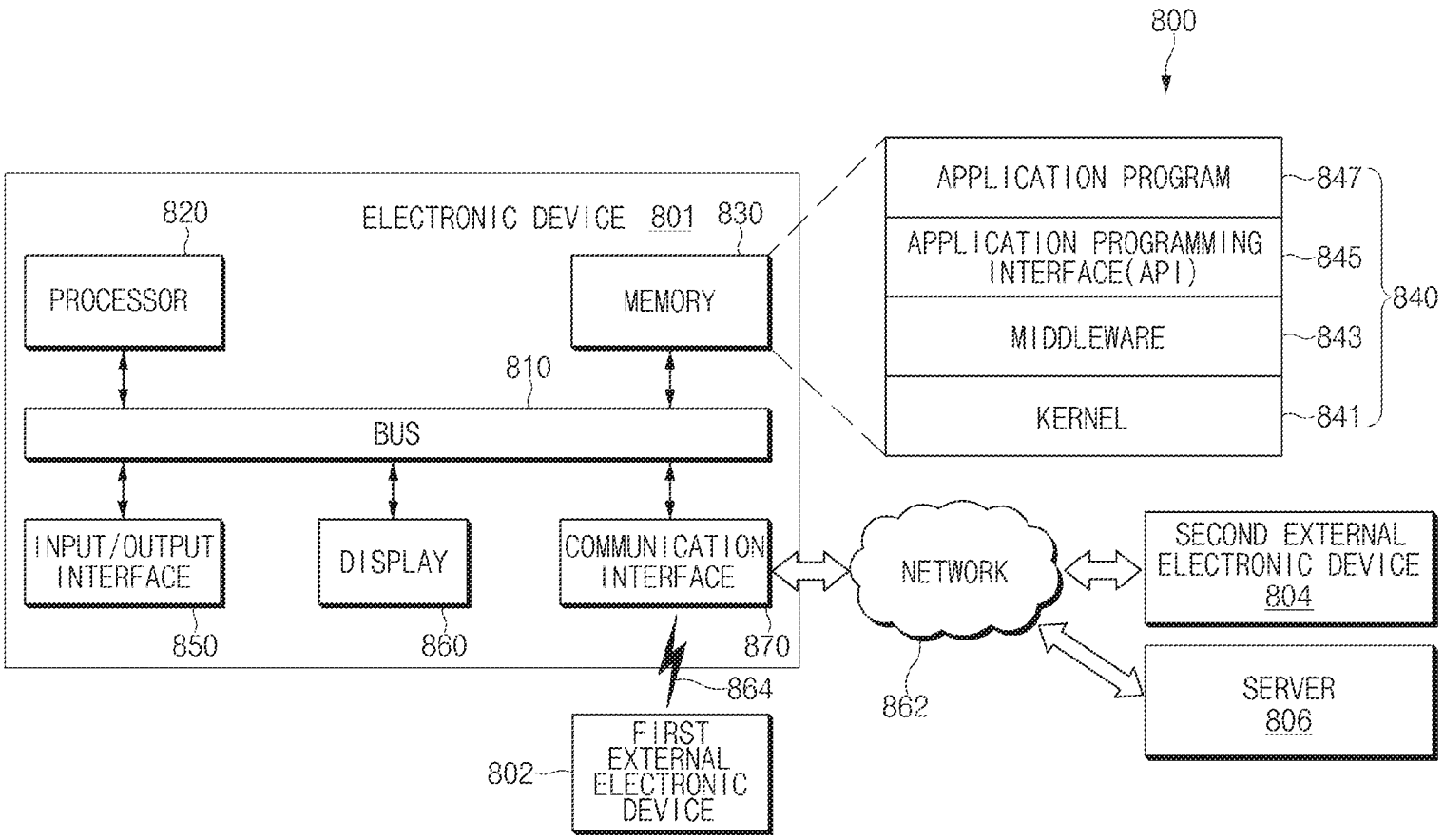
FIG. 8 is a diagram illustrating an example electronic device in a network environment according to various example embodiments.

FIG. 8 is a diagram illustrating an example electronic device in a network environment according to an example embodiment of the present disclosure.

An electronic device 801 in a network environment 800 according to various embodiments of the present disclosure will be described with reference to FIG. 8. The electronic device 801 may include a bus 810, a processor (e.g., including processing circuitry) 820, a memory 830, an input/output interface (e.g., including input/output circuitry) 850, a display 860, and a communication interface (e.g., including communication circuitry) 870. In various embodiments of the present disclosure, at least one of the foregoing elements may be omitted or another element may be added to the electronic device 801.

The bus 810 may include a circuit for connecting the above-mentioned elements 810 to 870 to each other and transferring communications (e.g., control messages and/or data) among the above-mentioned elements.

The processor 820 may include various processing circuitry, such as, for example, and without limitation, at least one of a dedicated processor, a central processing unit (CPU), an application processor (AP), or a communication processor (CP). The processor 820 may perform data processing or an operation related to communication and/or control of at least one of the other elements of the electronic device 801.

The memory 830 may include a volatile memory and/or a nonvolatile memory. The memory 830 may store instructions or data related to at least one of the other elements of the electronic device 801. According to an embodiment of the present disclosure, the memory 830 may store software and/or a program 840. The program 840 may include, for example, a kernel 841, a middleware 843, an application programming interface (API) 845, and/or an application program (or an application) 847. At least a portion of the kernel 841, the middleware 843, or the API 845 may be referred to as an operating system (OS).

The kernel 841 may control or manage system resources (e.g., the bus 810, the processor 820, the memory 830, or the like) used to perform operations or functions of other programs (e.g., the middleware 843, the API 845, or the application program 847). Furthermore, the kernel 841 may provide an interface for allowing the middleware 843, the API 845, or the application program 847 to access individual elements of the electronic device 801 in order to control or manage the system resources.

The middleware 843 may serve as an intermediary so that the API 845 or the application program 847 communicates and exchanges data with the kernel 841.

Furthermore, the middleware 843 may handle one or more task requests received from the application program 847 according to a priority order. For example, the middleware 843 may assign at least one application program 847 a priority for using the system resources (e.g., the bus 810, the processor 820, the memory 830, or the like) of the electronic device 801. For example, the middleware 843 may handle the one or more task requests according to the priority assigned to the at least one application, thereby performing scheduling or load balancing with respect to the one or more task requests.

The API 845, which is an interface for allowing the application 847 to control a function provided by the kernel 841 or the middleware 843, may include, for example, at least one interface or function (e.g., instructions) for file control, window control, image processing, character control, or the like.

The input/output interface 850 may include various input/output circuitry and serve to transfer an instruction or data input from a user or another external device to (an)other element(s) of the electronic device 801. Furthermore, the input/output interface 850 may output instructions or data received from (an)other element(s) of the electronic device 801 to the user or another external device.

The display 860 may include, for example, a liquid crystal display (LCD), a light-emitting diode (LED) display, an organic light-emitting diode (OLED) display, a microelectromechanical systems (MEMS) display, or an electronic paper display, or the like, but is not limited thereto. The display 860 may present various content (e.g., a text, an image, a video, an icon, a symbol, or the like) to the user. The display 860 may include a touch screen, and may receive a touch, gesture, proximity or hovering input from an electronic pen or a part of a body of the user.

The communication interface 870 may include various communication circuitry and set communications between the electronic device 801 and an external device (e.g., a first external electronic device 802, a second external electronic device 804, or a server 806). For example, the communication interface 870 may be connected to a network 862 via wireless communications or wired communications so as to communicate with the external device (e.g., the second external electronic device 804 or the server 806).

The wireless communications may employ at least one of cellular communication protocols such as long-term evolution (LTE), LTE-advance (LTE-A), code division multiple access (CDMA), wideband CDMA (WCDMA), universal mobile telecommunications system (UMTS), wireless broadband (WiBro), or global system for mobile communications (GSM). The wireless communications may include, for example, a short-range communications 864. The short-range communications may include at least one of wireless fidelity (Wi-Fi), Bluetooth, near field communication (NFC), magnetic stripe transmission (MST), or GNSS.

The MST may generate pulses according to transmission data and the pulses may generate electromagnetic signals. The electronic device 801 may transmit the electromagnetic signals to a reader device such as a POS (point of sales) device. The POS device may detect the magnetic signals by using a MST reader and restore data by converting the detected electromagnetic signals into electrical signals.

The GNSS may include, for example, at least one of global positioning system (GPS), global navigation satellite system (GLONASS), BeiDou navigation satellite system (BeiDou), or Galileo, the European global satellite-based navigation system according to a use area or a bandwidth. Hereinafter, the term "GPS" and the term "GNSS" may be interchangeably used. The wired communications may include at least one of universal serial bus (USB), high definition multimedia interface (HDMI), recommended standard 832 (RS-232), plain old telephone service (POTS), or the like. The network 862 may include at least one of telecommunications networks, for example, a computer network (e.g., local area network (LAN) or wide area network (WAN)), the Internet, or a telephone network.

The types of the first external electronic device 802 and the second external electronic device 804 may be the same as or different from the type of the electronic device 801. According to an embodiment of the present disclosure, the server 806 may include a group of one or more servers. A portion or all of operations performed in the electronic device 801 may be performed in one or more other electronic devices (e.g., the first electronic device 802, the second external electronic device 804, or the server 806). When the electronic device 801 should perform a certain function or service automatically or in response to a request, the electronic device 801 may request at least a portion of functions related to the function or service from another device (e.g., the first electronic device 802, the second external electronic device 804, or the server 806) instead of or in addition to performing the function or service for itself. The other electronic device (e.g., the first electronic device 802, the second external electronic device 804, or the server 806) may perform the requested function or additional function, and may transfer a result of the performance to the electronic device 801. The electronic device 801 may use a received result itself or additionally process the received result to provide the requested function or service. To this end, for example, a cloud computing technology, a distributed computing technology, or a client-server computing technology may be used.

Figure 9:
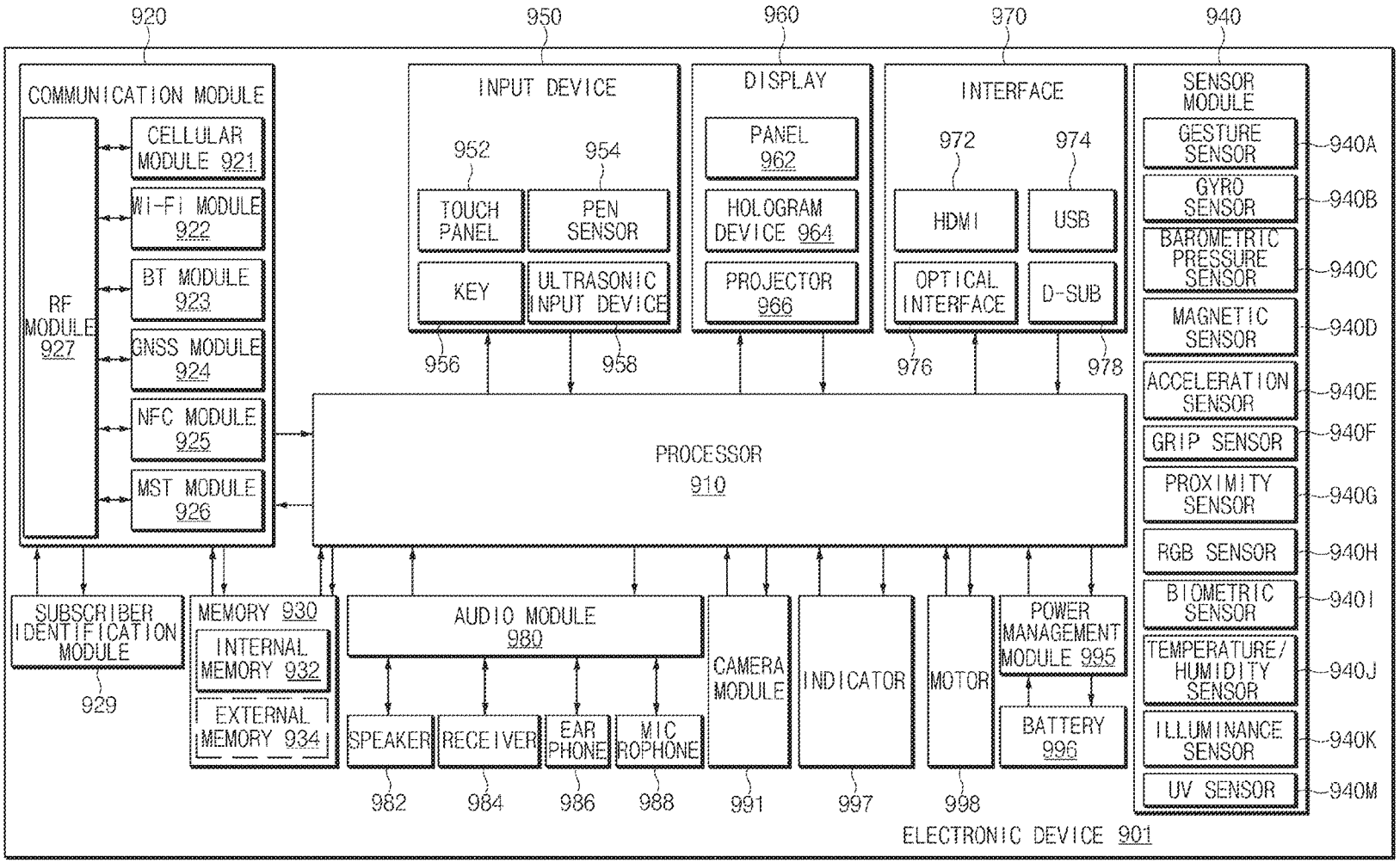
FIG. 9 is a block diagram illustrating an example electronic device according to various example embodiments.

FIG. 9 is a block diagram illustrating an example electronic device according to an example embodiment of the present disclosure.

Referring to FIG. 9, an electronic device 901 may include, for example, a part or the entirety of the electronic device 801 illustrated in FIG. 8. The electronic device 901 may include at least one processor (e.g., AP) (e.g., including processing circuitry) 910, a communication module (e.g., including communication circuitry) 920, a subscriber identification module (SIM) 929, a memory 930, a sensor module 940, an input device (e.g., including input circuitry) 950, a display 960, an interface (e.g., including interface circuitry) 970, an audio module 980, a camera module 991, a power management module 995, a battery 996, an indicator 997, and a motor 998.

The processor 910 may include various processing circuitry and run an operating system or an application program so as to control a plurality of hardware or software elements connected to the processor 910, and may process various data and perform operations. The processor 910 may be implemented with, for example, a system on chip (SoC). According to an embodiment of the present disclosure, the processor 910 may further include a graphic processing unit (GPU) and/or an image signal processor. The processor 910 may include at least a portion (e.g., a cellular module 921) of the elements illustrated in FIG. 9. The processor 910 may load, on a volatile memory, an instruction or data received from at least one of other elements (e.g., a nonvolatile memory) to process the instruction or data, and may store various data in a nonvolatile memory.

The communication module 920 may have a configuration that is the same as or similar to that of the communication interface 870 of FIG. 8. The communication module 920 may include various communication circuitry, such as, for example, and without limitation, at least one of a cellular module 921, a Wi-Fi module 922, a Bluetooth (BT) module 923, a GNSS module 924 (e.g., a GPS module, a GLONASS module, a BeiDou module, or a Galileo module), a NFC module 925, MST module 926 and a radio frequency (RF) module 927.

The cellular module 921 may provide, for example, a voice call service, a video call service, a text message service, or an Internet service through a communication network. The cellular module 921 may identify and authenticate the electronic device 901 in the communication network using the subscriber identification module 929 (e.g., a SIM card). The cellular module 921 may perform at least a part of functions that may be provided by the processor 910. The cellular module 921 may include a communication processor (CP).

Each of the Wi-Fi module 922, the Bluetooth module 923, the GNSS module 924 and the NFC module 925 may include, for example, a processor for processing data transmitted/received through the modules. According to some various embodiments of the present disclosure, at least a part (e.g., two or more) of the cellular module 921, the Wi-Fi module 922, the Bluetooth module 923, the GNSS module 924, and the NFC module 925 may be included in a single integrated chip (IC) or IC package.

The RF module 927 may transmit/receive, for example, communication signals (e.g., RF signals). The RF module 927 may include, for example, a transceiver, a power amp module (PAM), a frequency filter, a low noise amplifier (LNA), an antenna, or the like. According to another embodiment of the present disclosure, at least one of the cellular module 921, the Wi-Fi module 922, the Bluetooth module 923, the GNSS module 924, or the NFC module 925 may transmit/receive RF signals through a separate RF module.

The SIM 929 may include, for example, an embedded SIM and/or a card containing the subscriber identity module, and may include unique identification information (e.g., an integrated circuit card identifier (ICCID)) or subscriber information (e.g., international mobile subscriber identity (IMSI)).

The memory 930 (e.g., the memory 830) may include, for example, an internal memory 932 and/or an external memory 934. The internal memory 932 may include at least one of a volatile memory (e.g., a dynamic RAM (DRAM), a static RAM (SRAM), a synchronous dynamic RAM (SDRAM), or the like), a nonvolatile memory (e.g., a one-time programmable ROM (OTPROM), a programmable ROM (PROM), an erasable and programmable ROM (EPROM), an electrically erasable and programmable ROM (EEPROM), a mask ROM, a flash ROM, a flash memory (e.g., a NAND flash memory, a NOR flash memory, or the like)), a hard drive, or a solid state drive (SSD).

The external memory 934 may include a flash drive such as a compact flash (CF), a secure digital (SD), a Micro-SD, a Mini-SD, an extreme digital (xD), a MultiMediaCard (MMC), a memory stick, or the like. The external memory 934 may be operatively and/or physically connected to the electronic device 901 through various interfaces.

The sensor module 940 may, for example, measure physical quantity or detect an operation state of the electronic device 901 so as to convert measured or detected information into an electrical signal. The sensor module 940 may include, for example, at least one of a gesture sensor 940A, a gyro sensor 940B, a barometric pressure sensor 940C, a magnetic sensor 940D, an acceleration sensor 940E, a grip sensor 940F, a proximity sensor 940G, a color sensor 940H (e.g., a red/green/blue (RGB) sensor), a biometric sensor 940I, a temperature/humidity sensor 940J, an illumination (e.g., illuminance) sensor 940K, or an ultraviolet (UV) sensor 940M. Additionally or alternatively, the sensor module 940 may include, for example, an olfactory sensor (E-nose sensor), an electromyography (EMG) sensor, an electroencephalogram (EEG) sensor, an electrocardiogram (ECG) sensor, an infrared (IR) sensor, an iris recognition sensor, and/or a fingerprint sensor. The sensor module 940 may further include a control circuit for controlling at least one sensor included therein. In some various embodiments of the present disclosure, the electronic device 901 may further include a processor configured to control the sensor module 940 as a part of the processor 910 or separately, so that the sensor module 940 is controlled while the processor 910 is in a sleep state.

The input device 950 may include various input circuitry, such as, for example, and without limitation, a touch panel 952, a (digital) pen sensor 954, a key 956, or an ultrasonic input device 958. The touch panel 952 may employ at least one of capacitive, resistive, infrared, and ultraviolet sensing methods. The touch panel 952 may further include a control circuit. The touch panel 952 may further include a tactile layer so as to provide a haptic feedback to a user.

The (digital) pen sensor 954 may include, for example, a sheet for recognition which is a part of a touch panel or is separate. The key 956 may include, for example, a physical button, an optical button, or a keypad. The ultrasonic input device 958 may sense ultrasonic waves generated by an input tool through a microphone 988 so as to identify data corresponding to the ultrasonic waves sensed.

The display 960 (e.g., the display 860) may include a panel 962, a hologram device 964, or a projector 966. The panel 962 may have a configuration that is the same as or similar to that of the display 860 of FIG. 8. The panel 962 may be, for example, flexible, transparent, or wearable. The panel 962 and the touch panel 952 may be integrated into a single module. The hologram device 964 may display a stereoscopic image in a space using a light interference phenomenon. The projector 966 may project light onto a screen so as to display an image. The screen may be disposed in the inside or the outside of the electronic device 901. According to an embodiment of the present disclosure, the display 960 may further include a control circuit for controlling the panel 962, the hologram device 964, or the projector 966.

The interface 970 may include various interface circuitry, such as, for example, and without limitation, an HDMI 972, a USB 974, an optical interface 976, or a D-subminiature (D-sub) 978. The interface 970, for example, may be included in the communication interface 870 illustrated in FIG. 8. Additionally or alternatively, the interface 970 may include, for example, a mobile high-definition link (MHL) interface, an SD card/multi-media card (MMC) interface, or an infrared data association (IrDA) interface.

The audio module 980 may convert, for example, a sound into an electrical signal or vice versa. At least a portion of elements of the audio module 980 may be included in the input/output interface 850 illustrated in FIG. 8. The audio module 980 may process sound information input or output through a speaker 982, a receiver 984, an earphone 986, or the microphone 988.

The camera module 991 is, for example, a device for shooting a still image or a video. According to an embodiment of the present disclosure, the camera module 991 may include at least one image sensor (e.g., a front sensor or a rear sensor), a lens, an image signal processor (ISP), or a flash (e.g., an LED or a xenon lamp).

The power management module 995 may manage power of the electronic device 901. According to an embodiment of the present disclosure, the power management module 995 may include a power management integrated circuit (PMIC), a charger integrated circuit (IC), or a battery or gauge. The PMIC may employ a wired and/or wireless charging method. The wireless charging method may include, for example, a magnetic resonance method, a magnetic induction method, an electromagnetic method, or the like. An additional circuit for wireless charging, such as a coil loop, a resonant circuit, a rectifier, or the like, may be further included. The battery gauge may measure, for example, a remaining capacity of the battery 996 and a voltage, current or temperature thereof while the battery is charged. The battery 996 may include, for example, a rechargeable battery and/or a solar battery.

The indicator 997 may display a specific state of the electronic device 901 or a part thereof (e.g., the processor 910), such as a booting state, a message state, a charging state, or the like. The motor 998 may convert an electrical signal into a mechanical vibration, and may generate a vibration or haptic effect. Although not illustrated, a processing device (e.g., a GPU) for supporting a mobile TV may be included in the electronic device 901. The processing device for supporting a mobile TV may process media data according to the standards of digital multimedia broadcasting (DMB), digital video broadcasting (DVB), MediaFLO™, or the like.

According to various example embodiments, an electronic device includes a display panel configured to output content through a plurality of pixels, a display driver integrated circuit configured to transmit a driving signal for driving the display panel, and a processor configured to transmit image data and/or a control signal to the display driver integrated circuit, wherein, in the case where the display driver integrated circuit receives first image data transmitted together with a command of a first command group from the processor, the display driver integrated circuit stores the first image data in a first memory area, and wherein, in the case where the display driver integrated circuit receives second image data transmitted together with a command of a second command group from the processor, the display driver integrated circuit stores the second image data in a second memory area different from the first memory area.

According to various example embodiments, the display driver integrated circuit operates the display panel based on the first and second image data respectively stored in the first memory area and the second memory area, while the processor is deactivated.

According to various example embodiments, the first image data includes data for outputting a background image maintained while the processor is deactivated, and the second image data includes data for outputting an object updated depending on a specified time period and/or a specified event while the processor is deactivated.

According to various example embodiments, the object includes at least one of: a hand of an analog clock, a number or a division sign of a digital clock, an icon, a mouse pointer, or a touch pointer.

According to various example embodiments, the first image data is output to a first layer of the display panel, and the second image data is used to generate an object to be output to a second layer overlaid on the first layer.

According to various example embodiments, the first command group includes a recording start command configured to start recording data in the first memory area, and a recording continuousness command configured to continuously record the data in the first memory area.

According to various example embodiments, the recording start command includes image data combined with a 2Ch command according to a mobile industry processor interface (MIPI) standard, and the recording continuousness command includes image data combined with a 3Ch command according to the MIPI standard.

According to various example embodiments, the second command group includes a recording start command to start recording data in the second memory area, and a recording continuousness command to continuously record the data in the second memory area.

According to various example embodiments, the recording start command of the second command group includes one or two of commands from 00h to FFh other than a 2Ch command and a 3Ch command according to a mobile industry processor interface (MIPI) standard, and the recording continuousness command of the second command group includes one or two of commands from 00h to FFh other than the 2Ch command, the 3Ch command, and a command allocated to the recording start command.

According to various example embodiments, the first memory area and the second memory area are respectively implemented with different areas in one graphics random access memory (RAM) or are respectively implemented with graphics RAMs physically independent of each other.

According to various example embodiments, the processor is configured to generate additional information based on transparency of each of the pixels, to generate conversion data that includes the additional information and is smaller in size than base data of the pixels, and to transmit the conversion data to the display driver integrated circuit, and the display driver integrated circuit is configured to store the conversion data in the second memory area as the second image data.

According to various example embodiments, the conversion data includes a red (R) component, a green (G) component, and a blue (B) component of each of the pixels and the additional information, and the display driver integrated circuit displays the red (R) component with a first number of levels, displays the green (G) component with a second number of levels, displays the blue (B) component with a third number of levels, and displays the additional information with a fourth number of levels, while the processor is deactivated or activated.

According to various example embodiments, a sum of the first to fourth numbers is smaller than a sum of bits of the transparency, the red (R) component, the green (G) component, and the blue (B) component of each pixel, which are included in the base data.

According to various example embodiments, a sum of the first to fourth numbers is equal to a value of a bit width allocated to each pixel of the display panel.

According to various example embodiments, the additional information includes at least one of transparency information of each pixel, and information on whether each pixel is disposed in an edge area where the transparency is changed by a specified value or more.

According to various example embodiments, the conversion data is transmitted to the display driver integrated circuit, together with a display driving command or image data transmitted from the processor to the display panel.

According to various example embodiments, the display driving command has a bus width of a 8-bit unit for one command, and the conversion data transmits a parameter of 256 bytes or more in one command.

Each of the elements described herein may be configured with one or more components, and the names of the elements may be changed according to the type of an electronic device. In various example embodiments of the present disclosure, an electronic device may include at least one of the elements described herein, and some elements may be omitted or other additional elements may be added. Furthermore, some of the elements of the electronic device may be combined with each other so as to form one entity, so that the functions of the elements may be performed in the same manner as before the combination.

The term "module" used herein may refer, for example, to a unit including one of hardware, software and firmware or a combination thereof. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include, for example, and without limitation, at least one of a dedicated processor, a CPU, an application-specific integrated circuit (ASIC) chip, a field-programmable gate array (FPGA), and a programmable-logic device for performing some operations, which are known or will be developed.

At least a part of devices (e.g., modules or functions thereof) or methods (e.g., operations) according to various embodiments of the present disclosure may be implemented as instructions stored in a computer-readable storage medium in the form of a program module. In the case where the instructions are performed by a processor (e.g., the processor 820), the processor may perform functions corresponding to the instructions. The computer-readable storage medium may be, for example, the memory 830.

A computer-readable recording medium may include a hard disk, a floppy disk, a magnetic medium (e.g., a magnetic tape), an optical medium (e.g., CD-ROM, digital versatile disc (DVD)), a magneto-optical medium (e.g., a floptical disk), or a hardware device (e.g., a ROM, a RAM, a flash memory, or the like). The program instructions may include machine language codes generated by compilers and high-level language codes that can be executed by computers using interpreters. The above-mentioned hardware device may be configured to be operated as one or more software modules for performing operations of various embodiments of the present disclosure and vice versa.

A module or a program module according to various example embodiments of the present disclosure may include at least one of the above-mentioned elements, or some elements may be omitted or other additional elements may be added. Operations performed by the module, the program module or other elements according to various embodiments of the present disclosure may be performed in a sequential, parallel, iterative or heuristic way. Furthermore, some operations may be performed in another order or may be omitted, or other operations may be added.

While the present disclosure has been illustrated and described with reference to various example embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a display panel configured to output content through a plurality of pixels;

a display driver integrated circuit comprising a plurality of logic circuits configured at least to transmit a driving signal for driving the display panel; and at least one processor configured to transmit image data and a control signal to the display driver integrated circuit, wherein, in the case where the display driver integrated circuit receives first image data and a first control signal related to the first image data from the processor, the display driver integrated circuit is configured to store the first image data in a first memory area of the display driver integrated circuit, wherein, in the case where the display driver integrated circuit receives second image data and a second control signal related to the second image data from the processor, the display driver integrated circuit is configured to store the second image data in a second memory area of the display driver integrated circuit, wherein a portion of the plurality of logic circuits of the display driver integrated circuit is configured to combine the first image data from the first memory area with the second image data from the second memory area, and output the combined image data to the display panel while the processor is in sleep state, and wherein the first image data to be combined is maintained and the second image data to be combined is to be periodically modified by the display driver integrated circuit depending on at least one of a specified time period and a specified event while the processor is in sleep state.

2. The electronic device of claim 1, wherein the display driver integrated circuit is configured to operate the display panel based on the first and second image data stored in the first memory area and the second memory area, respectively, while the processor is deactivated.

3. The electronic device of claim 1, wherein the object includes at least one of: a hand of an analog clock, a number or a division sign of a digital clock, an icon, a mouse pointer, or a touch pointer.

4. The electronic device of claim 1, wherein the display driver integrated circuit is configured to output first image data to a first layer of the display panel, and wherein the second image data is usable to generate an object to be output to a second layer of the display panel overlaid on the first layer.

5. The electronic device of claim 1, wherein the first control signal includes a recording start command usable to start recording data in the first memory area, and a recording continuousness command usable to continuously record the data in the first memory area.

6. The electronic device of claim 5, wherein the recording start command includes image data combined with a 2Ch command according to a mobile industry processor interface (MIPI) standard, and wherein the recording continuousness command includes image data combined with a 3Ch command according to the MIPI standard.

7. The electronic device of claim 1, wherein the second control signal includes a recording start command usable to start recording data in the second memory area, and a recording continuousness command usable to continuously record the data in the second memory area.

8. The electronic device of claim 7, wherein the recording start command of the second control signal includes one or two of commands from 00h to FFh other than a 2Ch command and a 3Ch command according to a mobile industry processor interface (MIPI) standard, and wherein the recording continuousness command of the second control signal includes one or two of commands from 00h to FFh other than the 2Ch command, the 3Ch command, and a command allocated to the recording start command.

9. The electronic device of claim 1, wherein the first memory area and the second memory area are provided in different areas in one graphics random access memory (RAM), or are implemented with graphics RAMs physically independent of each other.

10. The electronic device of claim 1, wherein the processor is configured to generate additional information based on transparency of each of the pixels, to generate conversion data that includes the additional information, the conversion data being smaller in size than base data of the pixels, and to transmit the conversion data to the display driver integrated circuit, and wherein the display driver integrated circuit is configured to store the conversion data in the second memory area as the second image data.

11. The electronic device of claim 10, wherein the conversion data includes a red (R) component, a green (G) component, and a blue (B) component of each of the pixels and the additional information, and wherein the display driver integrated circuit is configured to display the red (R) component with a first number of levels, to display the green (G) component with a second number of levels, to display the blue (B) component with a third number of levels, and to display the additional information with a fourth number of levels.

12. The electronic device of claim 11, wherein a sum of the first number, the second number, the third number and the fourth number is less than a sum of bits of the transparency, the red (R) component, the green (G) component, and the blue (B) component of each pixel, which are included in the base data.

13. The electronic device of claim 11, wherein a sum of the first number, the second number, the third number and the fourth number is equal to a value of a bit width allocated to each pixel of the display panel.

14. The electronic device of claim 10, wherein the additional information includes at least one of: transparency information of each pixel, and information on whether each pixel is disposed in an edge area where the transparency is changed by a specified value or more.

15. The electronic device of claim 10, wherein the processor is configured to transmit conversion data to the display driver integrated circuit, together with a display driving command or image data transmitted to the display panel.

16. The electronic device of claim 15, wherein the display driving command has a bus width of a 8-bit unit for one command, and wherein the conversion data is configured to be transmitted having a parameter of 256 bytes or more in one command.

17. A method for processing an image, performed in an electronic device including a display, the method comprising:

generating, at a processor, first image data;

transmitting, at the processor, the first image data and a first control signal to the first image data to a display driver integrated circuit driving the display;

storing, at the display driver integrated circuit, the first image data in a first memory area of the display driver integrated circuit;

generating, at the processor, second image;

transmitting, at the processor, the second image data and a second control signal related to the second image data to the display driver integrated circuit;

storing, at the display driver integrated circuit, the second image data in a second memory area of the display driver integrated circuit, the second memory area being different than the first memory area;

combining, at the display driver integrated circuit, the first image data from the first memory area with the second image data from the second memory area, and outputting the combined image data to the display while the processor is in sleep state, wherein the first image data to be combined is maintained and the second image data to be combined is periodically modified by the display driver integrated circuit depending on at least one of a specified time period and a specified event while the processor is in sleep state.

18. The method of claim 17, wherein the generating of the second image data includes:

generating additional information based on transparency of each of pixels; and generating conversion data including the additional information wherein the conversion data is smaller in size than base data of the pixels.

* * * * *